US008281970B2

(12) United States Patent
Demskey

(10) Patent No.: US 8,281,970 B2
(45) Date of Patent: Oct. 9, 2012

(54) BACKPACK HAVING A LOAD COMPENSATING STRAP ARRANGEMENT

(76) Inventor: Joan F. Demskey, New York City, NY (US)

( * ) Notice: Subject to any disclaimer, the term of this patent is extended or adjusted under 35 U.S.C. 154(b) by 295 days.

(21) Appl. No.: 12/765,437

(22) Filed: Apr. 22, 2010

(65) Prior Publication Data

US 2010/0270348 A1 Oct. 28, 2010

Related U.S. Application Data

(60) Provisional application No. 61/214,483, filed on Apr. 24, 2009.

(51) Int. Cl.
*A45F 3/02* (2006.01)
*A45F 3/04* (2006.01)

(52) U.S. Cl. ..... 224/579; 224/612; 224/617; 224/622; 224/628

(58) Field of Classification Search ..... 224/153–156, 224/578–580, 627–659, 608, 612; D3/216, D3/217

See application file for complete search history.

(56) References Cited

U.S. PATENT DOCUMENTS

| | | | | |
|---|---|---|---|---|
| 2,210,351 | A | 8/1940 | Westendorf | |
| 4,458,834 | A * | 7/1984 | Rosen | 224/160 |
| 4,810,102 | A * | 3/1989 | Norton | 383/4 |
| 4,826,060 | A | 5/1989 | Hollingsworth | |
| 5,012,964 | A | 5/1991 | Falletta et al. | |
| 5,415,332 | A * | 5/1995 | Kliot | 224/153 |
| 5,431,317 | A | 7/1995 | Kliot | |
| 5,547,051 | A * | 8/1996 | Bartscht et al. | 190/26 |
| 5,577,652 | A * | 11/1996 | Cooper | 224/578 |
| D383,305 | S * | 9/1997 | Holstrom | D3/216 |
| 5,971,244 | A | 10/1999 | Jaeger | |
| 5,988,474 | A * | 11/1999 | Smith et al. | 224/578 |
| 6,164,505 | A * | 12/2000 | Holter et al. | 224/259 |
| 6,164,509 | A | 12/2000 | Gausling et al. | |
| 6,189,750 | B1 * | 2/2001 | Von Neumann | 224/153 |

(Continued)

FOREIGN PATENT DOCUMENTS

JP 2000 004917 A 1/2000

OTHER PUBLICATIONS

Dunn, C., "Piezoelectric Backpack Concept: Take a Walk, Charge Your Gadgets", Retrieved online at www.treehugger.com/files/2007/10/piezoelectric_b.php (Oct. 9, 2007).

*Primary Examiner* — Justin Larson
(74) *Attorney, Agent, or Firm* — Hamilton, Brook, Smith & Reynolds, P.C.

(57) ABSTRACT

A backpack including a pack portion having a top, a bottom, a front, a rear and two sides. A strap arrangement can also be included for carrying the pack portion as a backpack. The strap arrangement can have a pair of carrying straps. Each carrying strap can be secured to the pack portion at about the bottom and extend upwardly along respective sides of the pack portion, and redirected at about the top of said respective sides to extend around to the rear of the pack portion, and being redirected at about the top of the rear to extend downwardly for securement at about the bottom of the pack portion at the rear. The strap arrangement can redirect forces to support a load in the pack portion from the sides of the pack portion.

28 Claims, 12 Drawing Sheets

U.S. PATENT DOCUMENTS

| | | | | |
|---|---|---|---|---|
| 6,220,493 | B1 * | 4/2001 | Iijima et al. | 224/578 |
| 6,257,472 | B1 | 7/2001 | Freedman | |
| D452,993 | S * | 1/2002 | Norman | D3/214 |
| 6,460,746 | B1 | 10/2002 | Amram | |
| 6,772,883 | B2 | 8/2004 | Lindamood | |
| 6,863,202 | B2 | 3/2005 | Ammerman | |
| 6,889,882 | B1 | 5/2005 | Leep | |
| 7,156,918 | B2 | 1/2007 | Marks | |
| 7,160,028 | B1 | 1/2007 | Linday | |
| 7,204,399 | B2 | 4/2007 | Collier et al. | |
| 7,391,123 | B2 | 6/2008 | Rome | |
| 7,404,506 | B1 | 7/2008 | Ross | |
| 7,619,884 | B1 | 11/2009 | Gray | |
| 2008/0277434 | A1 * | 11/2008 | Sacks | 224/153 |
| 2009/0184143 | A1 | 7/2009 | Witt et al. | |
| 2010/0213224 | A1 * | 8/2010 | Barr | 224/153 |

* cited by examiner

BACKPACK HAVING A LOAD COMPENSATING STRAP ARRANGEMENT

RELATED APPLICATION

This application claims the benefit of U.S. Provisional Application No. 61/214,483, filed on Apr. 24, 2009. The entire teachings of the above application are incorporated herein by reference.

BACKGROUND

Backpacks in the prior art typically have shoulder straps which extend from the rear of the pack to allow the user to carry the pack. The weight is mostly borne from the top part of the backpack with the bulk of the weight in the backpack falling to the bottom, and outwards from the user's body at an offset distance from the body. If the weight in the backpack is heavy, the backpack can pull the user backwardly and become uncomfortable. The user usually has to lean forward to maintain balance and compensate for the load while walking.

SUMMARY

The present invention can provide a backpack which can distribute and carry weight better then prior backpacks, and therefore can carry more weight more comfortably. The backpack can include a pack portion having a top, a bottom, a front, a rear and two sides. A strap arrangement can also be included for carrying the pack portion as a backpack. The strap arrangement can have a pair of carrying straps. Each carrying strap can be secured to the pack portion at about the bottom and extend upwardly along respective sides of the pack portion, and redirected at about the top of said respective sides to extend around to the rear of the pack portion, and being redirected at about the top of the rear to extend downwardly for securement at about the bottom of the pack portion at the rear. The strap arrangement can redirect forces to support a load in the pack portion from the sides of the pack portion.

In particular embodiments, the pair of carrying straps can extend from a strap extending along the bottom of the pack portion and sewn to each side of the pack portion near the bottom to support the load from the bottom. Strap redirecting members can be secured to the pack portion at about the top of the pack portion on the two sides and at the rear, for redirecting each carrying strap while allowing the carrying strap to slide through the redirecting members. A side ring can be secured to each side of the pack portion near the top through which a respective carrying strap passes and is slidably redirected. Two rear rings can be secured to the rear of the pack portion near the top, each through which a respective carrying strap passes and is slidably redirected. The side rings and the rear rings can be generally positioned on a common level. The rear rings can be positioned close to each other on opposite sides of a vertical center line, and the two carrying straps can be secured at about the bottom of the pack portion at the rear, and close to each other on opposite sides of the vertical center line. A stiffening member can be included for stiffening at least an upper portion of the rear of the pack portion. Each carrying strap can be secured to the rear of the pack portion, at about the bottom with a releasable connector. Each rear ring can be secured to the rear of the pack portion near the top by a releasable connector. The strap arrangement can be disconnected from the backpack configuration and reconnected in a shoulder strap configuration. Each carrying strap can include at least one strap adjuster for adjusting the strap. The strap arrangement can include piezoelectric material for generating electricity. A solar cell system can be included on the pack portion.

The present invention can also provide a backpack having a pack portion formed of flexible material having a top, a bottom, a front, a rear, and two sides. A stiffening member can be secured to the rear for stiffening at least an upper portion of the pack portion. Strap redirecting members can be secured to the pack portion at about the top of the pack portion on the sides and at the rear, with a side strap redirecting member on each side, and two rear strap redirecting members at the rear which are also secured to the stiffening member. A strap arrangement can be included for carrying the pack portion as a back pack. The strap arrangement can have a pair of carrying straps. Each carrying strap can extend from the bottom of the pack portion and extend upwardly along respective sides of the pack portion, and redirected at about the top of said respective sides by the two side strap redirecting members to extend around to the rear of the pack portion, and being redirected at about the top of the rear by respective rear strap redirecting members to extend downwardly for securement at about the bottom of the pack portion at the rear. The strap arrangement can redirect forces to support a load in the pack portion from the bottom and sides of the pack portion.

The present invention can also provide a method of forming a back pack, including providing a pack portion having a top, a bottom, a rear and two sides. A strap arrangement can be secured to the pack portion for carrying the pack portion as a back pack. The strap arrangement can have a pair of carrying straps secured to the pack portion at about the bottom and extending upwardly along respective sides of the pack portion, and redirected at about the top of said respective sides to extend around to the rear of the pack portion, and being redirected at about the top of the rear to extend downwardly for securement at about the bottom of the pack portion at the rear. The strap arrangement can redirect forces to support a load in the pack portion from the sides of the pack portion.

In particular embodiments, the pair of carrying straps can extend from a strap extending along the bottom of the pack portion and sewn to each side of the pack portion near the bottom to support the load from the bottom. Strap redirecting members can be secured to the pack portion at about the top of the pack portion on the two sides and at the rear, for redirecting each carrying strap while allowing the carrying strap to slide through the redirecting member. A side ring can be secured to each side of the pack portion near the top through which a respective carrying strap passes and is slidably redirected. Two rear rings can be secured to the rear of the pack portion near the top, each through which a respective carrying strap passes and is slidably redirected. The side rings and the rear rings can be positioned generally on a common level. The rear rings can be positioned close to each other on opposite sides of the vertical center line, and the two carrying straps can be secured at about the bottom of the pack portion at the rear, and close to each other on opposite sides of the vertical center line. At least an upper portion of the rear of the pack portion can be stiffened with a stiffening member. Each carrying strap can be secured to the rear of the pack portion at about the bottom with a releasable connector. Each rear ring can be secured to the rear of the pack portion near the top by a releasable connector. The strap arrangement can be configured to be capable of being disconnected from the backpack configuration and reconnected in a shoulder strap configuration. Each carrying strap can be provided with at least one strap adjuster for adjusting the strap. The strap arrangement can be provided with piezoelectric material for generating electricity. A solar cell system can be positioned on the pack portion.

The present invention can also provide a method of using a back pack including providing a pack portion having a top, a bottom, a rear, and two sides. A strap arrangement can be secured to the pack portion for carrying the pack portion as a back pack. The strap arrangement can have a pair of carrying straps secured to the pack portion at about the bottom and extending upwardly along respective sides of the pack portion, and redirected at about the top of said respective sides to extend around to the rear of the pack portion, and being redirected at about the top of the rear to extend downwardly for securement at about the bottom of the pack portion at the rear. The strap arrangement can redirect forces to support a load in the pack portion from the sides of the pack portion.

The backpack in the present invention has a design that better distributes or carries weight than prior backpacks, and allows user and the backpack to carry weight more comfortably than conventional packs and in an upright position. Also, the backpack can be carried higher on the back and shoulders of the user In addition, the backpack can be more stable since the straps can extend on the sides, and is less susceptible to wriggling or swinging.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
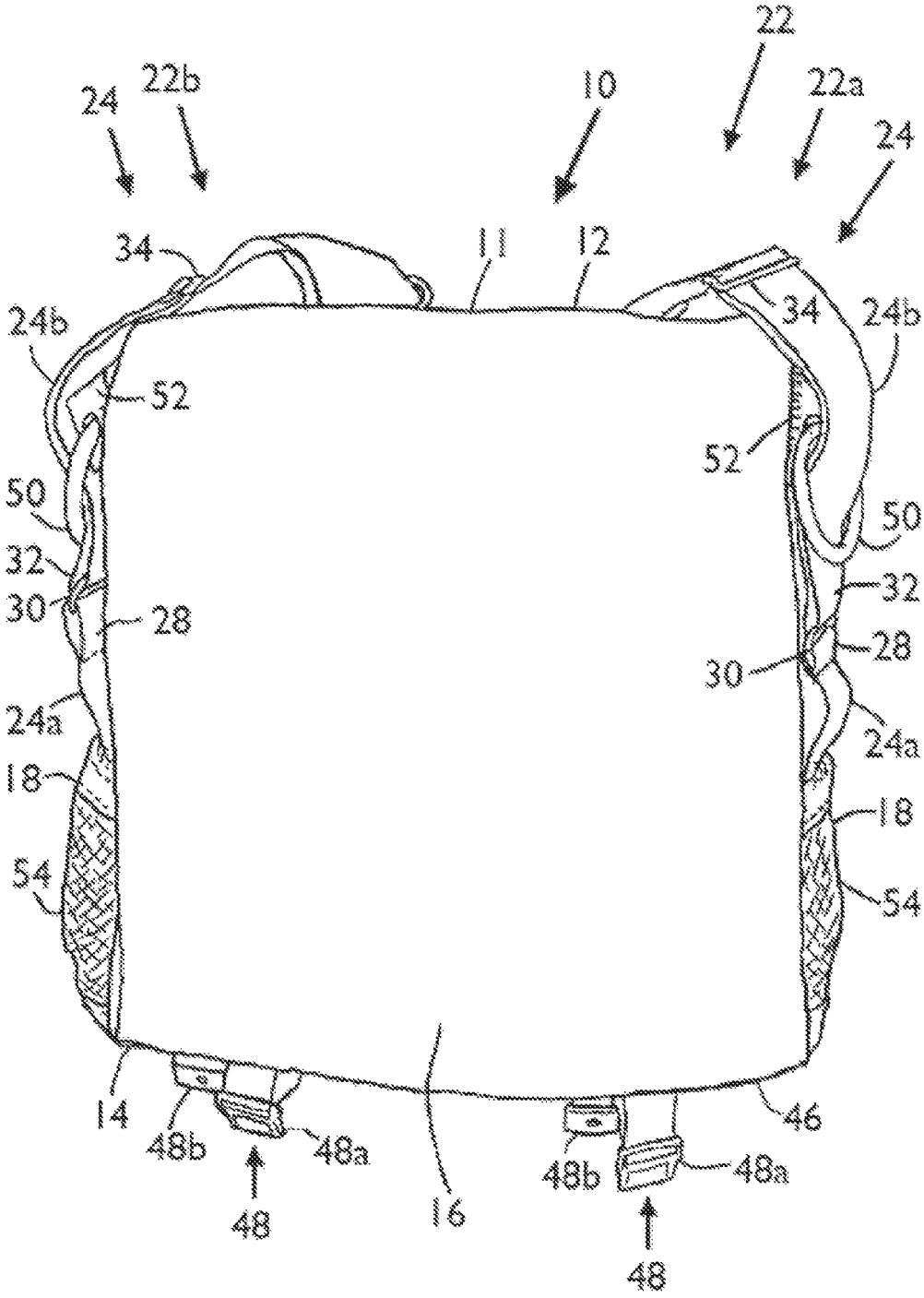
FIG. 1 is a front view of an embodiment of a backpack in the present invention.

Referring to FIGS. 1-8, backpack 10 is one embodiment of a backpack in the present invention and can include a pack portion 11, and a strap arrangement or assembly 22 for carrying the pack portion 11 as a backpack. The pack portion 11 can be made of flexible material suitable for a backpack, for example, nylon, denim, canvass, etc. The pack portion 11 can be generally square or rectangular and can have a top 12, a bottom 14, a front 16, a rear 20 and two sides 18 formed from the flexible material.

Figure 2:
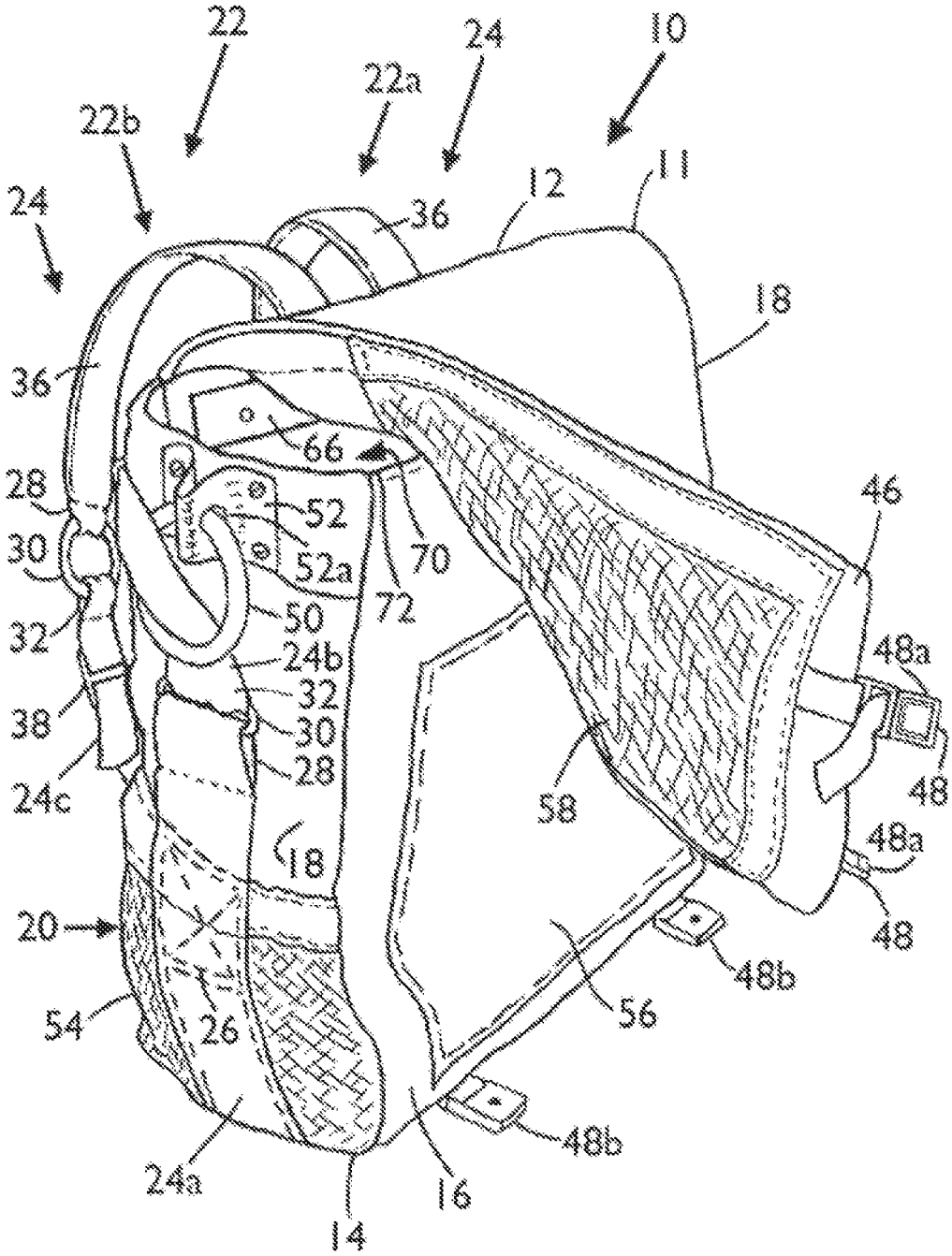
FIG. 2 is a front perspective view of the backpack.
Figure 4:
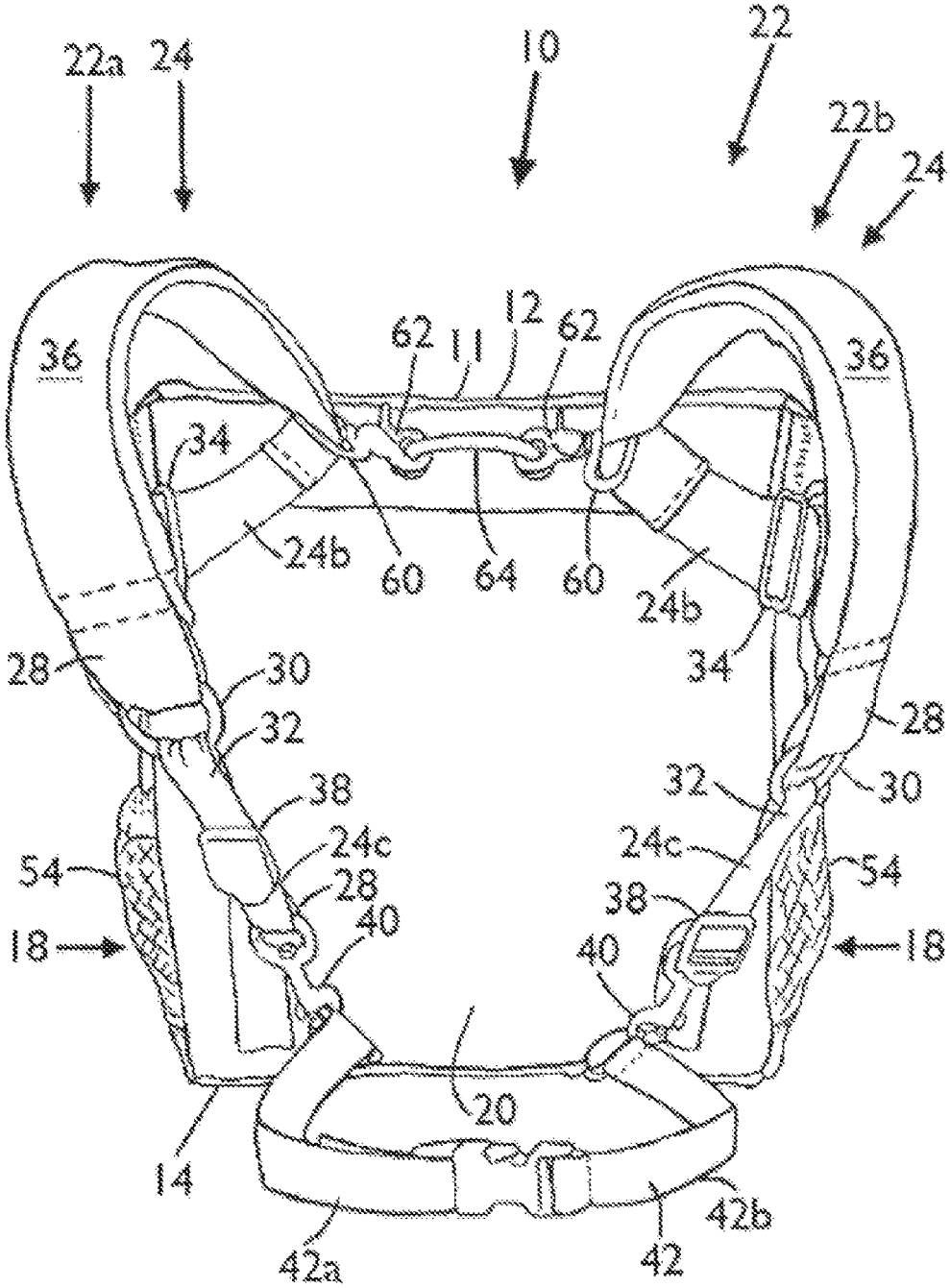
FIG. 4 is a rear view of the backpack.
Figure 8:
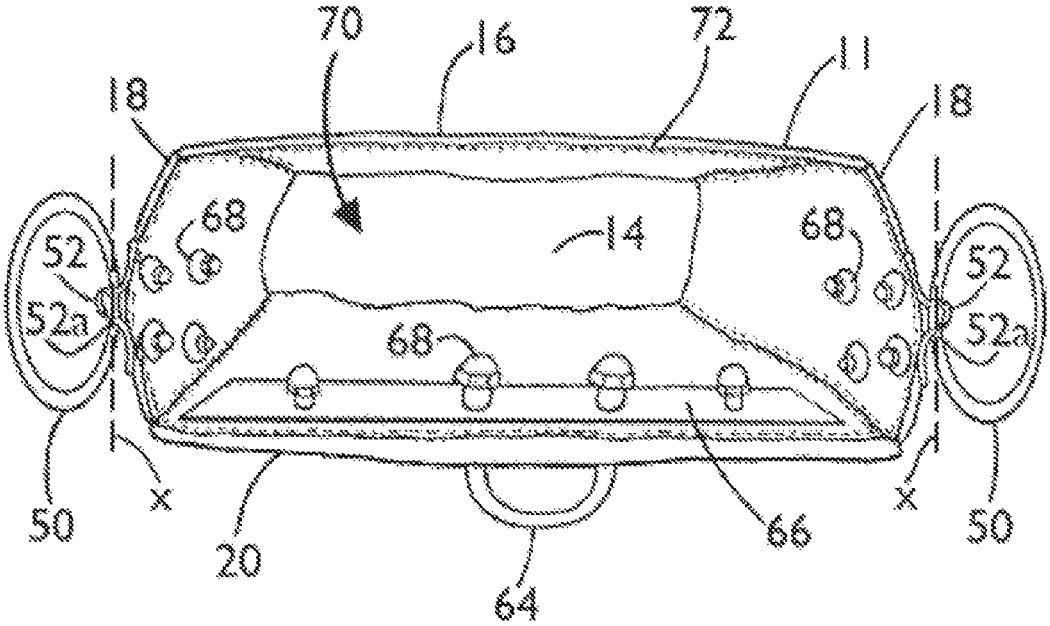
FIG. 8 is an interior view of the backpack with the strap arrangement omitted.

Referring to FIGS. 2 and 8, at least the upper portion of the rear 20 of the pack portion 11 can be stiffened or braced by a stiffening member 66. The stiffening member 66 can be a lateral or horizontally placed member of stiff material composition which can extend laterally across the width of the rear 20, a substantial portion or the majority of the width, or at least a portion of the width. The stiffening member 66 can be a metallic bar, such as steel, aluminum, titanium, etc, which can be secured by fasteners 68 to the interior of the rear 20, for example, by screws, bolts or rivets, as shown. The bar can be solid, perforated with holes, or can be hollow tubing. Alternatively, the stiffening member 66 can be held in place by adhesives, or sewn or held in a pocket, and can be on the exterior of the rear 20. In some embodiments, the stiffening member 66 can be made of other suitable materials and can be plastic, wood, paperboard, or composites, such as fiberglass or carbon fiber, and can be a plate or a board having a shape extending both laterally and vertically. A handle or ring 64 can be secured to stiffening member 66 and can extend from the rear 20 on the exterior side (FIG. 4).

Figure 3:
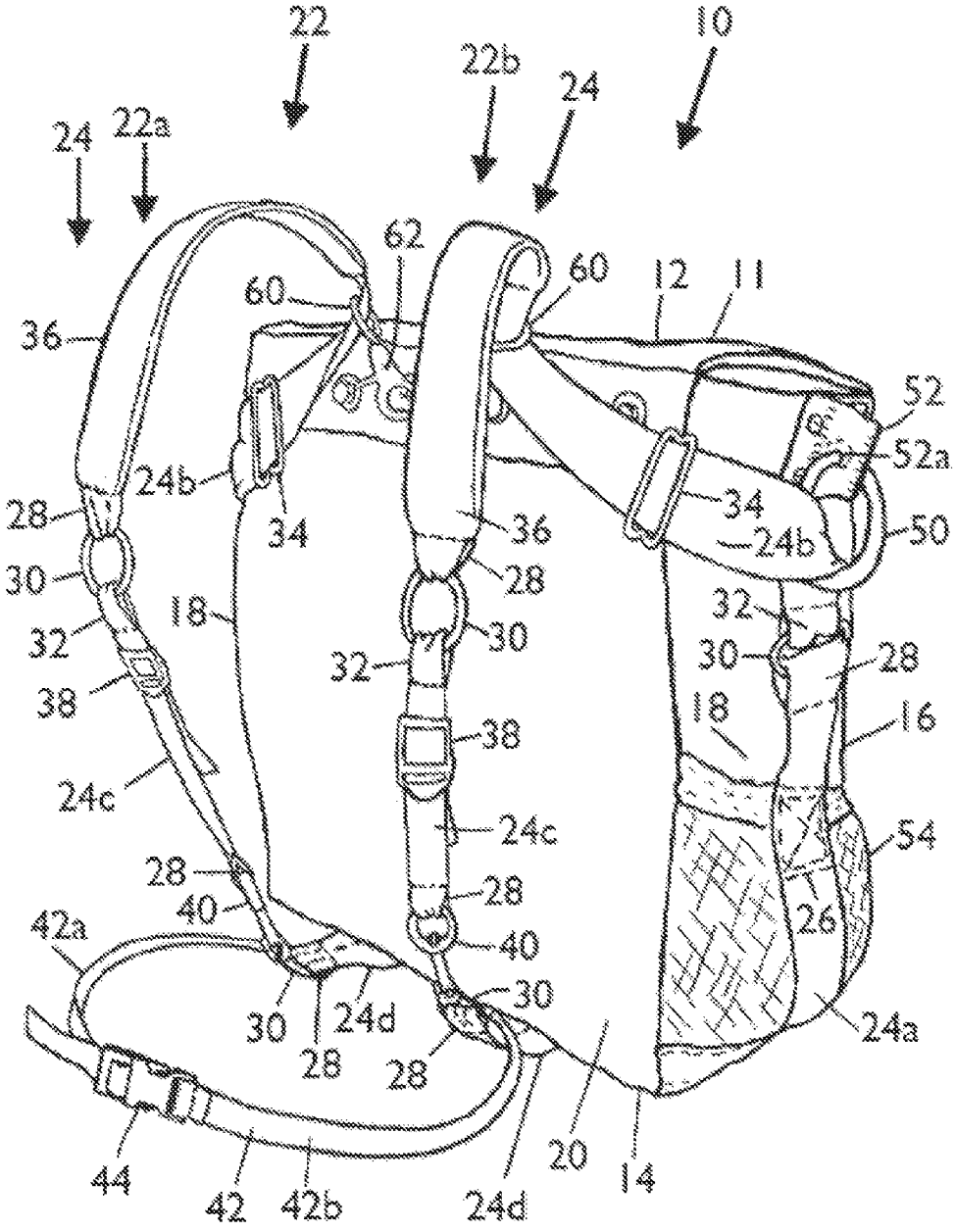
FIG. 3 is a rear perspective view of the backpack.

The strap arrangement 22 can include a right shoulder strap 22*a* and a left shoulder strap 22*b*, and each can consist of a length of strap 24 which can be formed of one or more strap segments. Referring to FIGS. 1-3, each strap 24 can extend upwardly from the sides 18 of the pack portion 11 from a strap segment 24*a*. The strap segment 24*a* can extend along the bottom 14 of the pack portion 11 (FIGS. 5 and 6) and can be sewn or stitched with stitching 26 on the bottom 20 and on the sides 18 near the bottom 20. Each strap 24 can extend along the central axis C (FIG. 9) up the sides 18 and through a side strap redirecting or pulley member 50 such as a ring, which can be secured near the top of the sides 18 along the central axis C by a mount 52. The mount 52 can rotatably support the ring 50 through a hole 52*a* on a horizontal axis X which allow the ring to pivot about axis X up and down, in a pivoting or rotational degree of freedom with the opening of the ring facing generally vertically for accepting the strap 24.

Figure 10:
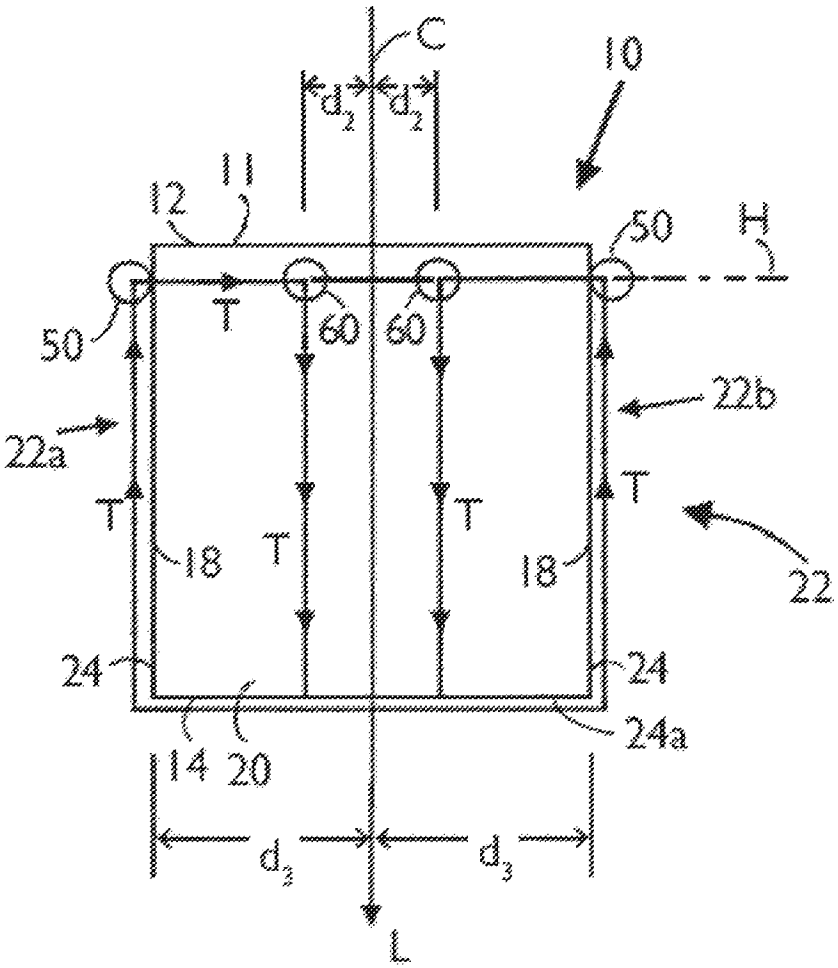
FIG. 10 is a rear schematic drawing of an embodiment of the backpack.

Each strap 24 that passes through the opening of the side strap redirecting member or ring 50 can be redirected at about a 90° or right angle from about a vertical orientation to about a horizontal or lateral orientation, before extending around the sides 18 to the rear 20 of the pack portion 11 around the exterior of the pack portion 11 in a manner that can make about a 90° or right angle lateral change in direction. Referring to FIGS. 3 and 4, the straps 24 can then extend generally laterally to two rear strap redirecting or pulley members 60, such as rings, near the top of the rear 20. The two rear rings 60 can be located close to each other and spaced apart on opposite sides of the central axis C (FIG. 10). The openings of the rear rings can face generally horizontally for accepting the straps 24. The straps 24 pass through the openings of the rear strap redirecting members or rings 60 and then can be redirected at about a 90° or right angle from about a lateral or horizontal orientation to about a vertical orientation, to extend downwardly to the bottom 14 at the rear 20, where the straps 24 are secured and spaced apart from each other on opposite sides of central axis C.

Figure 9:
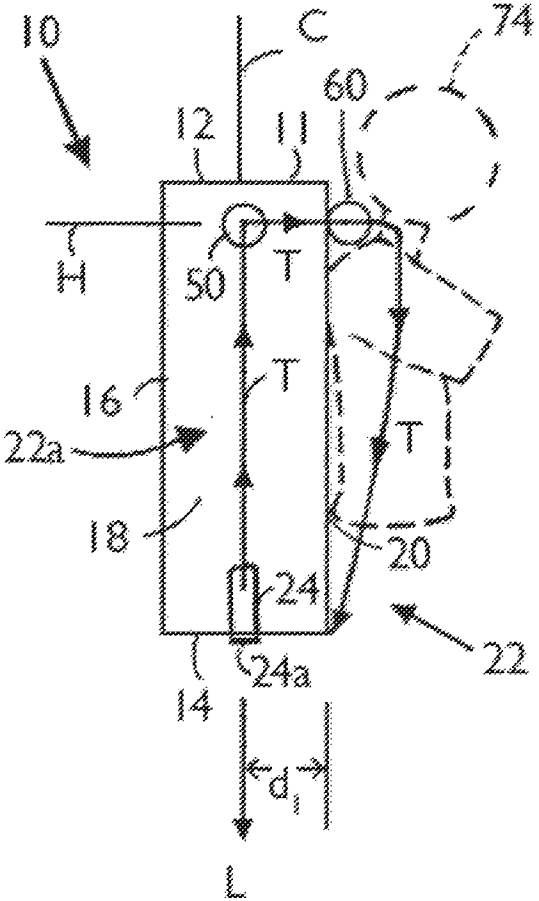
FIG. 9 is a side schematic drawing of an embodiment of the backpack.

Referring to FIGS. 9 and 10, the mechanics of the strap arrangement 22 can be seen. Referring to the side view of FIG. 9, the center of the weight of load L in the pack portion 11 is directed downwardly generally from the center of the pack portion 11, and is shown being on the central vertical axis or center line C. The load L is offset from the rear 20 of the pack portion 11 and the back of the user 74 by a rearwardly lateral offset distance of $d_1$. In a conventional backpack where the straps extend from the rear of the backpack, the center of the load L would typically act on the user 74 at the offset $d_1$ from the user's body and if the load L were heavy, the user 74 would typically have to lean forward to counteract the offset load and the moment arm force it forms, which tends to pull the user 74 backwardly. However, in the backpack 10, the straps 24 of the right 22*a* and left 22*b* shoulder straps can be secured to the sides 18 of the pack portion 11, near the bottom 14 in a centered manner, and extend upwardly along the sides 18 along the vertical central axis C of the pack portion 11. As a result, the center of the downward load L can be supported on the two opposite sides 18 by each strap 24 which is located at about the center of the load L at the vertical central axis C and at the offset distance $d_1$. By supporting the center of the load L at the offset distance $d_1$, the effects of the offset distance can be compensated for. Each strap 24 can carry half the load L (½ L), resulting in each strap 24 having a tension T from supporting its share of the load L. When the straps 24 extend from a strap segment 24*a* that extends along the bottom 14 of the pack portion 11 from one side 18 to the other side 18, the straps 24 can also carry or assist carrying the load L from the bottom 14 of the pack portion 11. The strap segment 24*a* can extend along the center of the bottom 14 at or on the center axis C, as seen in FIG. 9 to support the load L from the bottom 14 at the center of the load.

When the straps 24 reach about the top of the sides 18, the straps 24 each pass through a side strap redirecting member 50, such as the opening of a ring, and can be slidably redirected generally laterally rearwardly along the sides 18. The side strap redirecting members 50 can redirect the straps 24 and the tension T from a vertical direction to a generally lateral or horizontal direction relative to sides 18. Using rings as the side strap redirecting members 50 can allow the straps 24 to slide relative to the rings, thereby slidably changing direction in a manner that allows the tension T in the straps 24 to be transmitted on the other side of the rings in a pulley or pulley like manner. The straps 24 and the tension T can wrap around the rear corners of the pack portion 11, changing direction laterally in about a right angle, and, moving rearwardly from the sides 18 to inwardly along the rear 20. The straps 24 can extend generally laterally inwardly across the rear 20 as seen in FIG. 10, before reaching a rear strap redirecting member 60 and can be slidably redirected at about a right angle from a generally inward lateral or horizontal moving direction to a generally downward vertical direction, and then can be secured at about the bottom of the pack portion 11 at the rear 20. Using rings as the rear strap redirecting members 60 can allow the straps 24 to slide relative to the rings thereby slidably changing direction in a pulley or pulley like manner to transmit the tension T on the strap 24 from about a horizontal direction to about a downward vertical direction, at the rear 20 of the pack portion 11. The two vertical portions of the straps 24 of the right 22*a* and left 22*b* shoulder straps are typically the portions of the straps 24 that are worn on the shoulders of the user 74. The stiffing member 66 can define a stiffened or rigid width of the rear 20 to prevent the sides 18 from collapsing inwardly from the tension T of the straps 24.

Although the load L of the pack portion 11 is centered at an offset distance $d_1$ from the rear 20 of the pack portion 11 and the back of the user 74, which would normally form a moment arm force to pull the user 74 backwardly, the effects of the offset distance $d_1$ can be minimized or compensated by the straps 24 of the right 22*a* and left 22*b* shoulder straps extending upwardly along the sides 18 along the vertical central axis C to support the center of the load L along the sides 18 on the center or on axis C. The tension T on the two straps 24 supporting the load L can be transmitted upwardly along the straps 24 to about the top of the sides 18, where it is redirected generally laterally by the side strap redirecting members 50 around to the rear 20 and downwardly by the rear strap redirecting members 60. As a result, when the user 74 wears the right 22*a* and left 22*b* shoulder straps, the load L in the backpack 10 is transmitted by the redirected straps 24 and the tension T, from the center of the sides 18 to the portions of the straps 24 worn by the user 74, in a manner which can compensate for the offset distance $d_1$. By compensating for the offset distance $d_1$ by redirecting tension T, heavy loads can be carried, since typical moment arm forces which are formed by the offset distance in traditional packs are generally not formed. The strap redirecting members 50 and 60 can be positioned generally along a common horizontal plane or level H near the top of the pack portion 11, to prevent or minimize tilting of the pack portion 11 during use. Referring to FIG. 10, the rear strap redirecting members 60 can be spaced apart from each other and positioned on opposite sides of the vertical central axis C by a distance $d_2$. This distance $d_2$ can vary, and can be, for example, often between 1-5 inches for a pack portion 11 about 12-18 inches wide. The stiffening member 66 can stiffen the width of the rear 20 near the top and can maintain a desired position and/or spacing for the rear strap redirecting members 60. The two straps 24 can be secured at about the bottom by about the same distance $d_2$. By redirecting the two straps 24 close to and on opposite sides of the vertical central axis C, the load L of the pack portion 11 also can be transmitted by the tension T in the straps 24 close to the spine of the user 74 and on opposite sides by the distance $d_2$, thereby minimizing moment arm forces on the user 74 in the lateral side to side direction, which can also make it easier to carry heavier loads. The close positioning of the straps 24 relative to each other can help prevent the pack portion 11 from sliding off the user's 74 shoulders unintentionally. With the load L also being supported at the sides 18 of the pack portion 11 by the two straps 24 which are at the lateral sideward distance $d_3$ from the vertical central axis C, side wiggling or swinging can also be minimized. It is believed that such swinging can be caused by moment arm forces that are laterally sideward offset from the vertical central axis C, and with the straps 24 being positioned at the sides 18 by the distance $d_3$, such moment arm forces can be carried and compensated by this location of the straps 24. It is also believed that the horizontal rearwardly redirection of the straps 24 and tension Tat the top of the sides 18 can pull the top of the pack portion 11 tighter or closer and higher on the back of the user 74.

Additional details of particular embodiments now follows. In some embodiments, the pack portion 11 can have a height of 14-24 inches, a width of 12-20 inches and a depth of 4-8 inches, but can vary depending upon the situation. Different sizes can result from proportional sizing to fit a user's body, for example, small, medium, large or extra large sizes. The opening 72 to the interior 70 of the pack portion 11 (FIGS. 2 and 8) can be located at the top 12 and can be closed or covered with a flap 46. The flap can extend from the rear 20 over the front 16 of the pack portion 11, and can be secured by two adjustable securement clips 48, having a portion 48*a* on the flap 46 and a portion 48*b* on the pack portion 11. The front 16 and the interior of the flap 46 can each have a storage pocket 58. The storage pocket 58 can be made of netting or mesh material. The sides 18 can each have a pocket 54 at the bottom portion which can be mesh or netting, and extend over the straps 24. FIGS. 2 and 3 show the pockets 54 with portions broken away to show the underlying straps 24 for illustration purposes.

The straps 24 of the right 22*a* and left 22*b* shoulder straps can be formed of strap segments 24*a*, 24*b*, 24*c*, and 24*d*. Strap segment 24*a* can be a single strap that can extend along the center of the bottom 14 of the pack portion 11 and around the ends of the bottom 14 upwardly along the center of the sides 18. In other embodiments, strap segment 24*a* can have multiple straps. The strap segment 24*a* can be secured to each side 18 near the bottom, for example, by stitching 26 at about the lower third, or by other suitable means. The two opposite ends of the segment 24*a* can have a loop 28 secured to a ring 30 which connects each end of the strap segment 24*a* to a strap segment 24*b*, about halfway up the sides 18, before reaching the side strap redirecting members 50. Each strap segment 24*b* can be secured to the ring 30 by a loop 32, which can be adjusted by a strap adjuster 34, for adjusting the length of strap segment 24*b*. The strap segments 24*b* can each have a padded section 36 below the rear strap redirecting members 60 to provide comfort for the user 74. The ends of the strap segments 24*b* can have a loop 28 secured to a ring 30 which can connect to a strap segment 24*c*. Each strap segment 24*c* can be secured to a ring 30 by a loop 32 which can be adjusted by a strap adjuster 38 for adjusting the length of strap segment 24*c*. Having adjustability in both strap segments 24*b* and 24*c* can provide the user 74 with adjustment flexibility for making more precise adjustments for users of different body types or walks. The ends of each strap segment 24*c* can have a loop 28 secured to a releasable connector 40, that can have an openable ring or fastener, which can be spring loaded. Each releasable connector 40 can releasably secure a strap segment 24*c* to a strap segment 24*d*, thereby releasably securing the straps 24 to about the bottom of the pack portion 11 at the rear 20. Each strap segment 24*d* can be stitched with stitching 26 to and extend tranversely along the bottom 14 from about the center of the bottom 14 to the edge of the rear 20, after which a loop 28 secured to a ring 30 can extend. The releasable connectors 40 of strap segments 24*c* can connect to strap segments 24*d* by engaging the rings 30, which also allows for quick release at the bottom middle for easy removal of the pack portion 11. The strap segments 24*d* can be spaced apart by the distance $d_2$. The straps segments 24*a* and 24*d* can be stitched or attached to the bottom 14 and sides 18 of the pack portion 11 generally or mostly at non seam locations so that the strap segments 24*a* and 24*d* do not tear at seams when carrying weight.

A waist strap 42 can have portions 42*a* and 42*b* which are secured to the rings of strap segments 24*d*. The waist strap 42 can allow securement to the waist of the user 74 and can include a releasable latch 44. The waist strap 42 can pull the straps 24 closer together to the user's 74 shoulders in an inward fashion which can keep the straps 24 from sliding off the shoulders.

The mounts 52 for the side strap redirecting members 50 can be secured to the sides 18 by fasteners 68, such as screws, bolts or rivets. The mounts 52 can be mounted to the sides 18 over a rectangular or square region of the sides 18 to provide some rigidity or stiffness at the top of the sides 18. A handle 64 can be secured to the stiffening member 66 and extend from the rear 20 in a manner that is centered about axis C. The handle 64 can allow the pack portion 11 to be easily picked up by the user 74 and can also serve as a mount or securement location for the rear strap redirecting members 60 for desired positioning. Each rear strap redirecting member 60 can consist of a ring that is connected to a releasable connector 62, that can have an openable ring or fastener which can be spring loaded. The handle 64 can be sized to allow the rings 60 to be spaced apart from axis C by distance $d_2$. The handle 64 can be metal or plastic, but in some embodiments, can be fabric. The releasable connectors 62 can swivel to provide the rings 60 with freedom of movement. With the rear strap redirecting members 60 being secured to the handle 64, which in turn can be secured to the stiffening member 66, the load borne by the straps 24 can be transferred by the rear strap directing members 60 to the stiffening member 66. This can also prevent or minimize the load L from acting on or tearing at seams of the pack portion 11. In the embodiment shown in the drawings the strap redirecting members 60 have been shown as rings, and the rings can have round or flattened openings. In some embodiments, rollers can be provided to reduce friction. In other embodiments, the rings can be replaced by other suitable redirecting structures, including bands or loops of material or fabric through which the straps 24 can pass, roller pulleys, etc. Some embodiments of the redirecting members can slide easily, and others may slide very little or none at all. The hardware for the backpack 10, such as rings, adjusters, latches, releasable connectors, etc., can be standard components that are commercially available.

Figure 11:
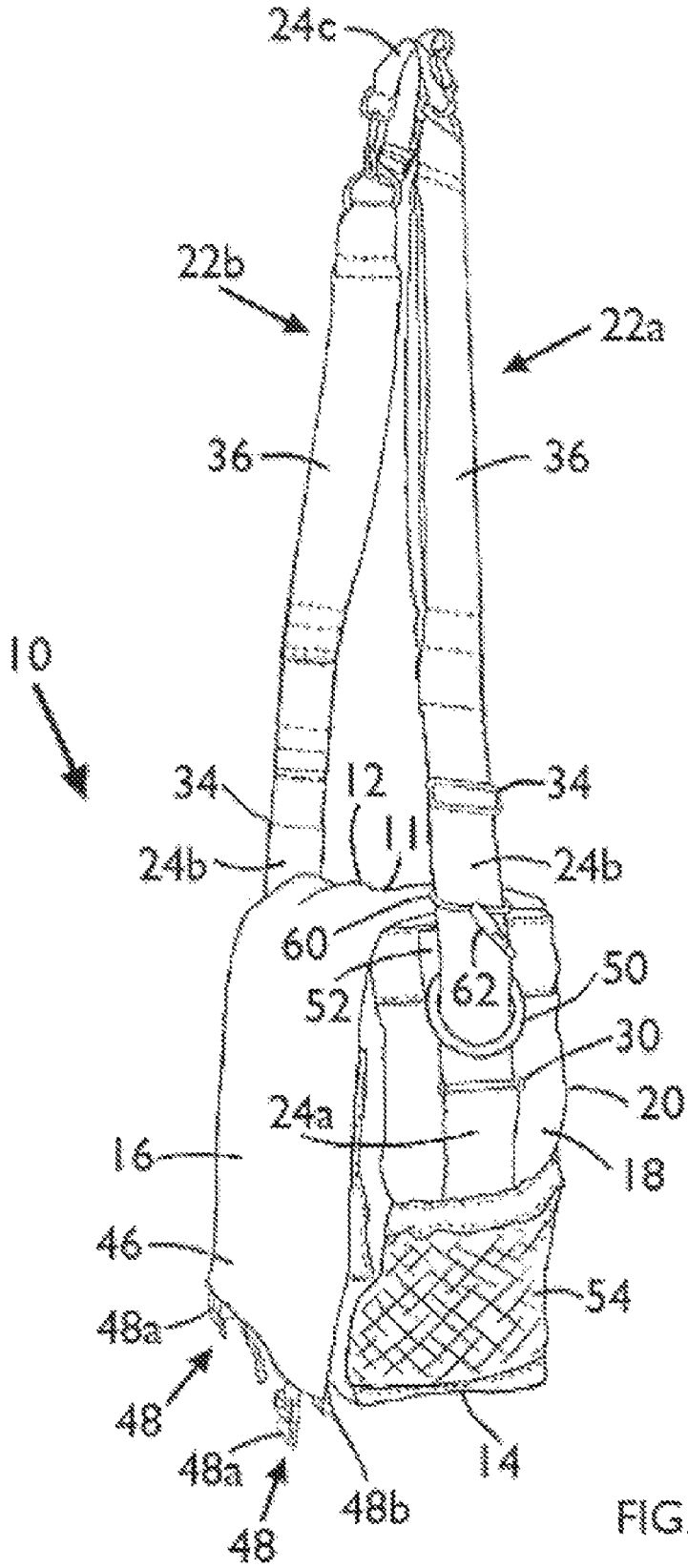
FIG. 11 is a side perspective view of the backpack with the strap arrangement connected as a shoulder bag.
Figure 12:
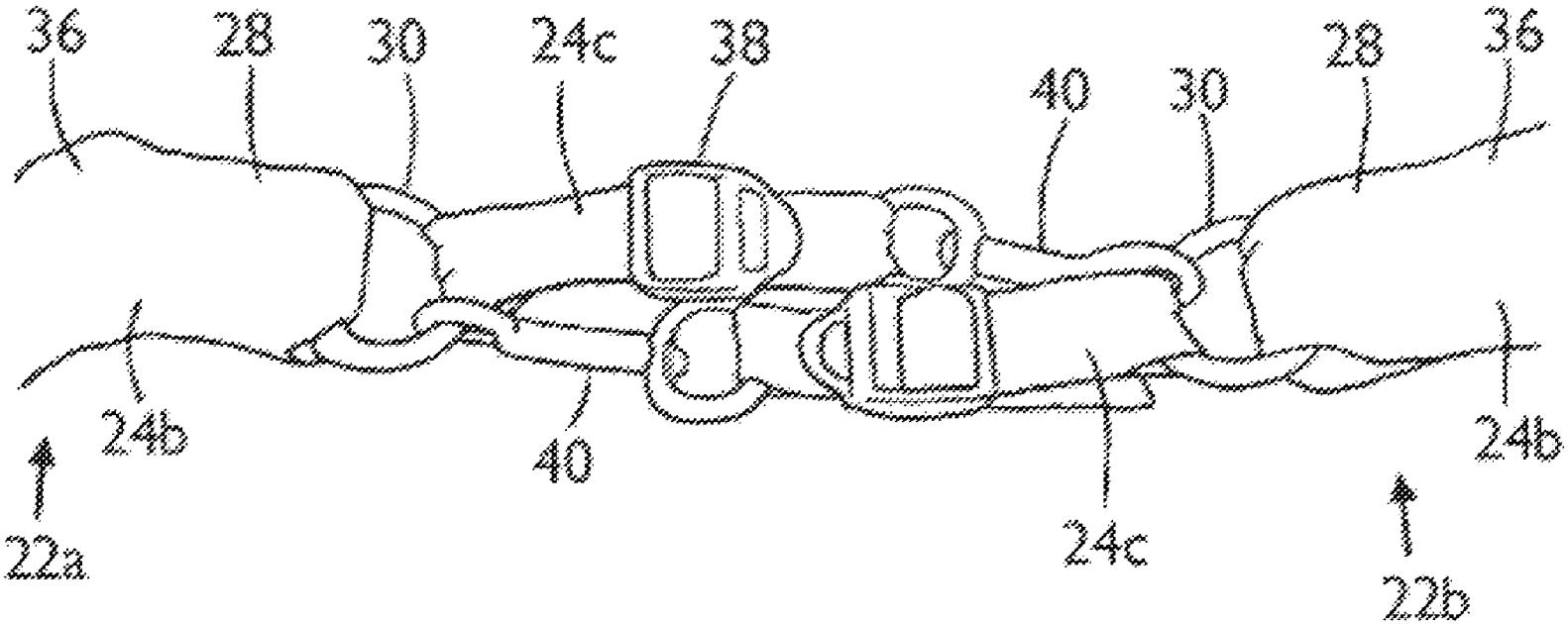
FIG. 12 is an enlarged view of a connection of straps for the configuration of FIG. 11.

Referring to FIGS. 11 and 12, the strap arrangement 22 can be disconnected from the backpack configuration and reconnected together in shoulder bag configuration. To accomplish this, the releasable connectors 62 of the rear strap redirecting members 60 are disconnected from handle 64, and the releasable connectors 40 of strap segments 24*c* are disconnected from strap segments 24*d*. The releasable connectors 40 of each strap segment 24*c* can then be connected with the ring 30 of a strap segment 24*b* in opposite and side by side relation (see FIG. 12).

Figure 13:
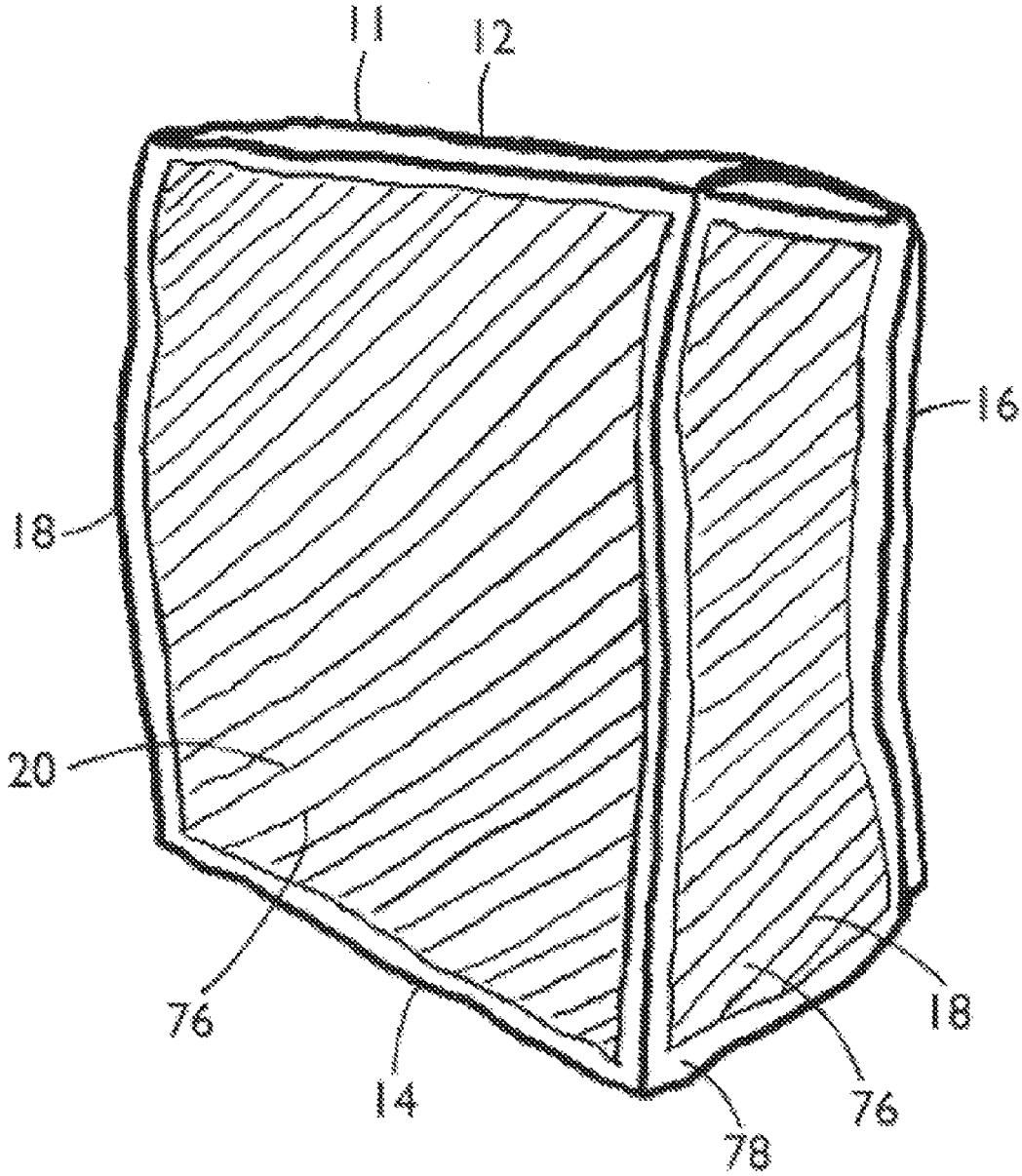
FIG. 13 is a rear perspective schematic view of a pack portion having stiffening members such as foam sewn into the pack portion.

Referring to FIG. 13, the pack portion 11 can in addition to the stiffening member 66, or in replacement of the stiffening member 66, include stiffening members 76 which can be attached to the sidewalls and bottom of the pack portion 11, for example by sewing, positioned in a pocket, or by adhesives. This can form a stiffened structure 78. In some embodiments, the stiffening members 76 can be foam panels or members, to form a soft stiffened structure, or an internal or integral soft frame. In embodiments where an upper horizontal stiffening member 66 is used in combination with foam stiffening members 76, the stiffening member 66 can also support or pull upwardly the bottom 14 via the foam stiffening members 76 of the stiffened structure 78. In other embodiments, more rigid materials can be used, such as plastic, paperboard, composites, metals, etc. In other embodiments, a stiffened structure 78 can be a separate component that is inserted into the pack portion 11 to provide stiffening. Furthermore, in some embodiments, the pack portion 11 can be partially or entirely rigid and can include rigid shell components.

Figure 5:
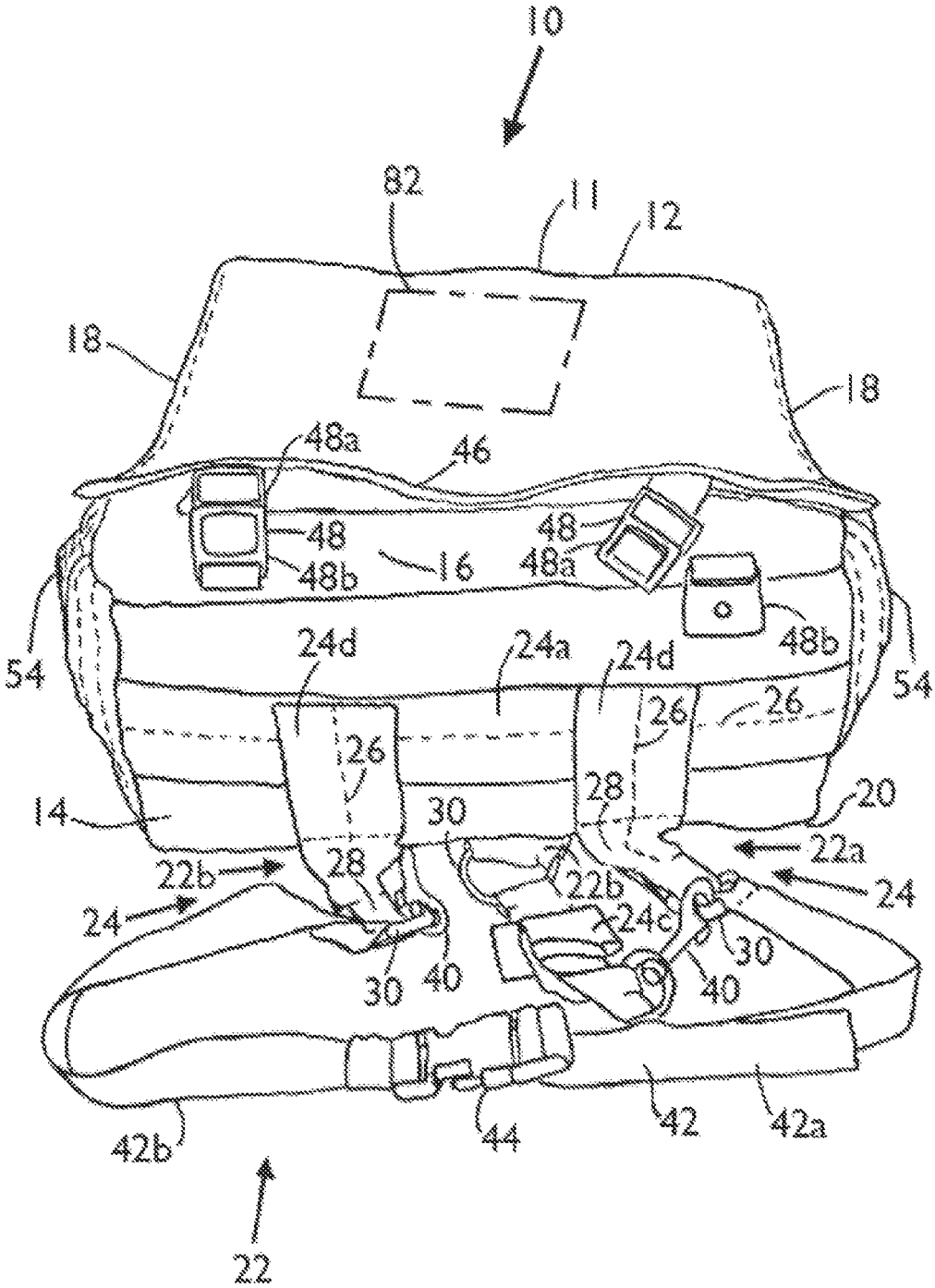
FIG. 5 is a front bottom view of the backpack.
Figure 6:
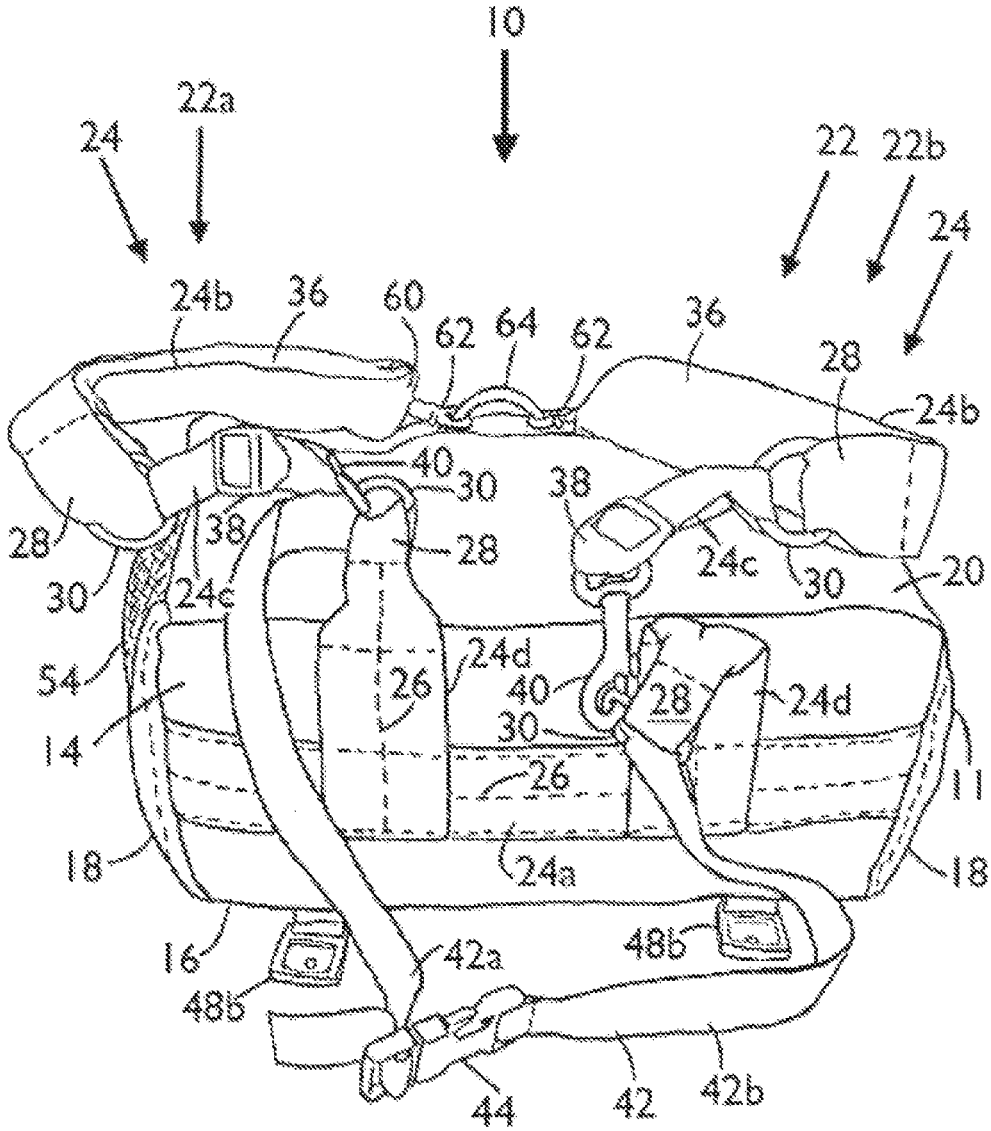
FIG. 6 is a rear bottom view of the backpack.
Figure 7:
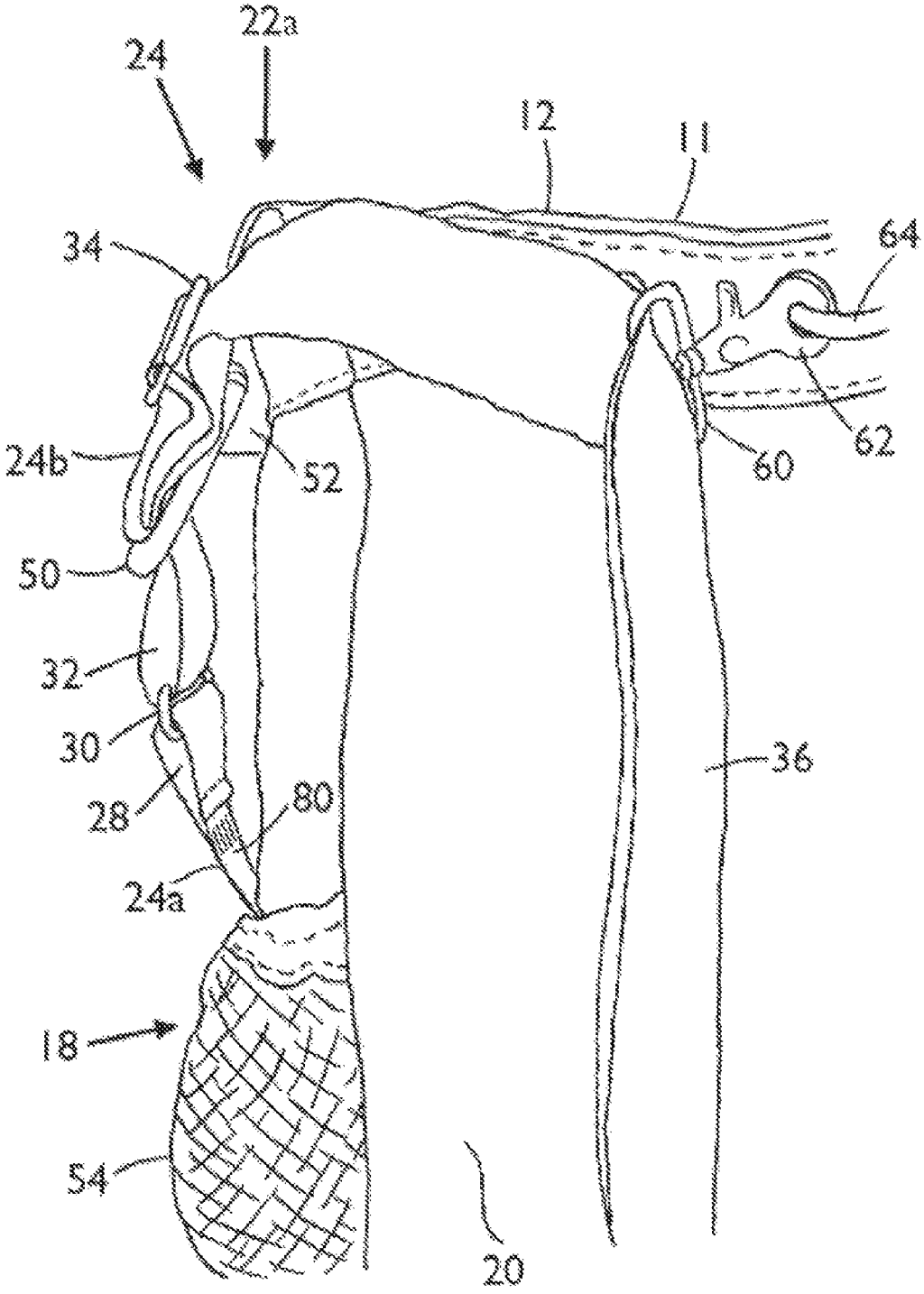
FIG. 7 is an enlarged view of an upper rear portion of the backpack showing the redirection of a carrying strap.

The backpack 10 can include a refrigeration or freezer unit for keeping items cool, which can be electrically powered. The refrigeration unit can include a battery and the straps 24, for example, on the sides 18, can include piezoelectric elements or material 80 (FIG. 7), or can be formed of piezoelectric strap material, for generating electricity, by the rising/falling tension forces encountered during walking. This can operate an electrical device, such as a refrigeration unit, or charge a battery. This can also be used for providing electricity to a computer, such as a laptop computer, when the backpack is used as a book or computer bag. In other embodiments, a heater can be powered. In addition, a solar cell system 82 can be provided on the pack portion 11 for generating electricity, for example on the flap 46 (FIG. 5).

While this invention has been particularly shown and described with references to example embodiments thereof, it will be understood by those skilled in the art that various changes in form and details may be made therein without departing from the scope of the invention encompassed by the appended claims. For example, although the straps 24 are shown extending from the sides 18 from or near the bottom 14, the straps 24 can be extended from positions higher up on the sides 18, depending upon the construction and materials of the pack portion 11. In addition, although the straps 24 have been described as being redirected between about vertical and horizontal positions, and redirected at about right angles, it is understood that these terms are approximations or generalizations since the straps 24 and the redirecting members 50 and 60 can move around a certain amount and can include near vertical and horizontal positions, and near right angles. In some embodiments "near" can include being off by a certain amount.

What is claimed is:

1. A backpack comprising:

a pack portion formed of flexible material having a top, a bottom, a front, a rear, and two sides;

a stiffening member secured to the rear for stiffening at least an upper portion of the pack portion;

strap redirecting members secured to the pack portion at upper regions of the pack portion on the sides and at the rear, a side strap redirecting member on each side, and at least one rear strap redirecting member at the rear which is also secured to the stiffening member; and a strap arrangement for carrying the pack portion as a backpack, the strap arrangement comprising a pair of carrying straps, each carrying strap extending from the bottom of the pack portion and extending upwardly along respective sides of the pack portion to movably pass through respective side strap redirecting members secured to upper regions of said respective sides, and movably redirected by the two side strap redirecting members to laterally extend around to the rear of the pack portion to movably pass through at least one rear strap redirecting member secured to upper regions of the rear, and being movably redirected by the at least one rear strap redirecting member to extend downwardly for securement at lower regions of the pack portion at the rear, the strap redirecting members movably redirecting each carrying strap while allowing the carrying straps to move through the redirecting members in a pulley like manner, the strap arrangement redirecting forces for supporting a load in the pack portion from the bottom and sides of the pack portion.

2. A backpack comprising:

a pack portion having a top, a bottom, a front, a rear, and two sides; and a strap arrangement for carrying the pack portion as a backpack, the strap arrangement comprising a pair of carrying straps, each carrying strap secured to the pack portion to at least one of the bottom and sides, and extending upwardly along respective sides of the pack portion to movably pass through respective side strap redirecting members secured to upper regions of said respective sides, and movably redirected by the side strap redirecting members to laterally extend around to the rear of the pack portion to movably pass through at least one rear strap redirecting member secured to upper regions of the rear, and being movably redirected by the at least one rear strap redirecting member to extend downwardly for securement at lower regions of the pack portion at the rear, the strap redirecting members movably redirecting each carrying strap while allowing the carrying straps to move through the redirecting members in a pulleylike manner, the strap arrangement redirecting forces for supporting a load in the pack portion from the sides of the pack portion.

3. The backpack of claim 2 in which the pair of carry straps extend from a strap extending along the bottom of the pack portion and sewn to lower regions of each side of the pack portion to support the load from the bottom.

4. The backpack of claim 2 further comprising a stiffening member for stiffening at least an upper portion of the rear of the pack portion.

5. The backpack of claim 2 in which each carrying strap includes at least one strap adjuster for adjusting the strap.

6. The backpack of claim 2 in which the strap arrangement includes piezoelectric material for generating electricity.

7. The backpack of claim 2 further comprising a solar cell system on the pack portion.

8. The backpack of claim 2 in which each carrying strap is secured to lower regions of the pack portion at the rear with a releasable connector.

9. The backpack of claim 8 in which the at least one rear ring is secured to upper regions of the rear of the pack portion by a releasable connector.

10. The backpack of claim 9 in which the strap arrangement can be disconnected from the backpack configuration and reconnected in a shoulder strap configuration.

11. The backpack of claim 2 in which the side strap redirecting members comprise a side ring secured to upper regions of each side of the pack portion through which a respective carrying strap passes and is slidably redirected.

12. The backpack of claim 11 in which the at least one rear strap redirecting member comprises at least one rear ring secured to upper regions of the rear of the pack portion through which a respective carrying strap passes and is slidably redirected.

13. The backpack of claim 12 in which the side rings and the at least one rear ring are mounted along a common plane.

14. The backpack of claim 13 in which the pair of carrying straps passing through the at least one rear ring are positioned apart from each other on opposite sides of a vertical centerline a distance $d_2$ from the centerline, and the carrying straps are secured at lower regions of the pack portion at the rear apart from each other on opposite sides of the vertical centerline about the distance $d_2$ from the centerline.

15. A method of using a backpack comprising:

providing a pack portion having a top, a bottom, a rear and two sides; and securing a strap arrangement to the pack portion for carrying the pack portion as a backpack, the strap arrangement comprising a pair of carrying straps secured to the pack portion to at least one of the bottom and sides, and extending upwardly along respective sides of the pack portion to movably pass through respective side strap redirecting members secured to upper regions of said respective sides, and movably redirected by the side strap redirecting members to laterally extend around to the rear of the pack portion to movably pass through at least one rear strap redirecting member secured to upper regions of the rear, and being movably redirected by the at least one rear strap redirecting member to extend downwardly for securement at lower regions of the pack portion at the rear, the strap redirecting members movably redirecting each carrying strap while allowing the carrying straps to move through the redirecting members in a pulleylike manner, the strap arrangement redirecting forces for supporting a load in the pack portion from the sides of the pack portion.

16. A method of forming a backpack comprising;

providing a pack portion having a top, a bottom, a rear and two sides; and securing a strap arrangement to the pack portion for carrying the pack portion as a backpack, the strap arrangement comprising a pair of carrying straps secured to the pack portion to at least one of the bottom and sides, and extending upwardly along respective sides of the pack portion to movably pass through respective side strap redirecting members secured to upper regions of said respective sides, and movably redirected by the side strap redirecting members to laterally extend around to the rear of the pack portion to movably pass through at least one rear strap redirecting member secured to upper regions of the rear, and being movably redirected by the at least one rear strap redirecting member to extend downwardly for securement at lower regions of the pack portion at the rear, the strap redirecting members movably redirecting each carrying strap while allowing the carrying straps to move through the redirecting members in a pulleylike manner, the strap arrangement redirecting forces for supporting a load from the sides of the pack portion.

17. The method of claim 16 further comprising extending the pair of carrying straps from a strap extending along the bottom of the pack portion and sewn to lower regions of each side of the pack portion to support the load from the bottom.

18. The method of claim 16 further comprising providing each carrying strap with at least one strap adjuster for adjusting the strap.

19. The method of claim 16 further comprising providing the strap arrangement with piezoelectric material for generating electricity.

20. The method of claim 16 further comprising positioning a solar cell system on the pack portion.

21. The method of claim 16 further comprising stiffening at least an upper portion of the rear of the pack portion with a stiffening member.

22. The method of claim 21 further comprising securing the at least one rear ring to upper regions of the rear of the pack portion by a releasable connector.

23. The method of claim 16 further comprising securing each carrying strap to lower regions of the pack portion at the rear with a releasable connector.

24. The method of claim 23 further comprising configuring the strap arrangement to be capable of being disconnected from the backpack configuration and reconnected in a shoulder strap configuration.

25. The method of claim 2 securing a side ring to upper regions of each side of the pack portion as the side strap redirecting members through which a respective carrying strap passes and is slidably redirected.

26. The method of claim 25 further comprising securing at least one rear ring to upper regions of the rear of the pack portion as the at least one rear strap redirecting member through which a respective carrying strap passes and is slidably redirected.

27. The method of claim 26 further comprising mounting the side rings and the at least one rear ring along a common plane.

28. The method of claim 27 further comprising positioning the pair of carrying straps passing through the at least one rear ring apart from each other on opposite sides of a vertical centerline a distance $d_2$ from the centerline, and the carrying straps are secured at lower regions of the pack portion at the rear apart from each other on opposite sides of the vertical centerline about the distance $d_2$ from the centerline.

* * * * *

UNITED STATES PATENT AND TRADEMARK OFFICE

CERTIFICATE OF CORRECTION

PATENT NO. : 8,281,970 B2
APPLICATION NO. : 12/765437
DATED : October 9, 2012
INVENTOR(S) : Joan F. Demskey It is certified that error appears in the above-identified patent and that said Letters Patent is hereby corrected as shown below:

In Column 6, line 46 delete "Tat" and insert -- T at --

In Column 12, Claim 25, line 14 delete "2" and insert -- 16 further comprising --

Signed and Sealed this
First Day of January, 2013

David J. Kappos

David J. Kappos
*Director of the United States Patent and Trademark Office*